US005667352A

United States Patent [19]

Curtin et al.

[11] Patent Number: 5,667,352

[45] Date of Patent: Sep. 16, 1997

[54] LOCKING SYSTEM FOR EXTENSION MEMBERS ON PORTABLE LIFTS

[75] Inventors: Richard M. Curtin, Redmond; Paul K. Smith, Kirkland; Matthew G. Kraemer, Seattle, all of Wash.

[73] Assignee: Genie Industries, Redmond, Wash.

[21] Appl. No.: 228,798

[22] Filed: Apr. 18, 1994

[51] Int. Cl.[6] ..... B66C 23/04

[52] U.S. Cl. ..... 414/667; 212/901

[58] Field of Search ..... 414/427, 667; 212/292, 302, 306, 901; 187/232, 242, 243

[56] References Cited

U.S. PATENT DOCUMENTS

| | | | |
|---|---|---|---|
| 1,598,928 | 9/1926 | O'Dell | 212/292 |
| 2,917,189 | 12/1959 | Isaacs | 212/901 X |
| 3,263,837 | 8/1966 | Noller et al. | 212/292 X |
| 3,266,598 | 8/1966 | Henne | 212/292 X |
| 4,650,392 | 3/1987 | Casteel | 212/901 X |
| 4,749,324 | 6/1988 | Rulison | 212/901 X |
| 5,505,578 | 4/1996 | Fuller | 212/901 X |

FOREIGN PATENT DOCUMENTS

| | | | |
|---|---|---|---|
| 1321667 | 7/1987 | U.S.S.R. | 212/302 |

*Primary Examiner*—James W. Keenan
*Attorney, Agent, or Firm*—Seed and Berry LLP

[57] ABSTRACT

A locking system for extension members on portable lifts or the like has a wedge block with a jaw face on one side and a sloped wedge face on the opposite side engaging a complementing fixed sloped face so that when the wedge block is moved upwardly the complementing faces cause the wedge block to also move horizontally into clamping position by way of the jaw face. The wedge block is moved upwardly responsive to turning of a screw threaded into the block.

5 Claims, 2 Drawing Sheets

LOCKING SYSTEM FOR EXTENSION MEMBERS ON PORTABLE LIFTS

TECHNICAL FIELD

The present invention relates to locking of extension stability members on the base of portable lifts and the like.

BACKGROUND OF THE INVENTION

On single and multi-stage portable lifts it is common to add stability by extending reach arms and outriggers from the base. If the lift has front load forks or other load raising elements and does not have a rear counterbalance, it is known to provide a pair of ground engaging reach arms extending forwardly from the base of the lift on the outside of the forks for stability. However, if the load to be lifted is carried on a pallet, the pallet cannot be lifted if it is wider than the distance between the reach arms. This difficulty can be solved if the space between the reach arms can be readily adjusted sufficiently and the reach arms can be reliably locked in adjusted position.

SUMMARY OF THE INVENTION

In accordance with the present invention a lift is provided with a base having two elongated laterally-extending sockets, one having an entry on the right side of the base and the other having an entry on the left side. The sockets are arranged with one behind the other and each preferably has a rectangular cross-section to slidably receive complementing mounting members secured at the rear of a pair of forwardly extending reach arms. Outward movement of the mounting members in the sockets extends the distance between the reach arms.

Adjacent the entry of each socket the base has a chamber open to the socket. The wall of each chamber facing the respective socket is sloped downwardly away from the socket. The slope of this wall is matched by the slope of a sloped wedge face on a wedge block housed in the chamber and shorter than the chamber height. The opposite face of the wedge block is a flat jaw face to engage an opposing wall of the adjacent mounting member. By this arrangement raising of the wedge blocks will lock the mounting members relative to the base of the lift because as the sloped wedge faces of the wedge blocks move upwardly in engagement with the sloped chamber walls, the wedge blocks are faced toward the sockets. Raising is accomplished by respective screws extending downwardly through slots in the base into threaded holes in the wedge blocks. The heads of these screws bear down against the upper ends of respective spacer tubes through which the screws loosely extend. The spacer tubes are seated on the base at the slots therein. As the screws are tightened the blocks raise and responsively move against the mounting members of the reach arms to lock them in place.

DETAILED DESCRIPTION OF THE INVENTION

Figure 1:
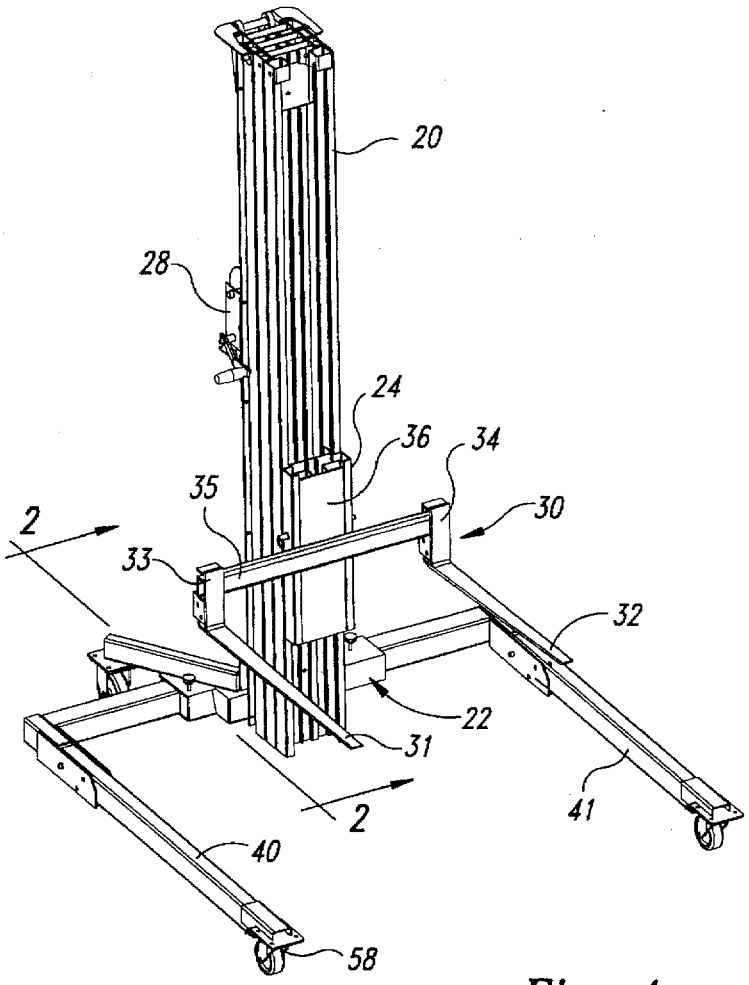
FIG. 1 is a perspective view of a portable lift embodying the invention.

Referring to the drawings, a portable fork lift is illustrated of the type having an extruded aluminum mast 20 mounted on a base unit 22. A duplicate shorter length of the mast stock serves as a carriage frame 24 and has rollers (not shown) which ride in opposed front channels on the mast 20. The carriage frame is typically operated by a cable which is dead-ended on the mast, passes down around a pulley on the carriage frame, passes over a pulley at the top of the mast, and is wound on the drum of a winch 28 mounted on the back of the mast. The described reeving arrangement is well known and is not shown. Mounted on the carriage frame 24 is a fork unit 30 having a pair of forwardly projecting forks 31, 32 mounted on brackets 33, 34 hanging from the ends of a cross-arm 35 which is in turn mounted on a box tube 36 bolted to the carriage frame.

The base unit 22 has a front mast mounting plate 37 and presents front-and-back elongated sockets 38–39 extending side to side which, in the illustrated example, open to the left and to the right, respectively. The sockets are of square cross-section to slidably receive complementing tubular extensible mounting members 42–43 at the back of right and left reach arm units 40–41. The base unit 22 has a pair of rearwardly diverging tubular members 45–46 mounted on the top thereof which project rearwardly and have mounting pads 47 for receiving caster units 48. These casters are complemented by caster units 58 at the front of the reach arms 40–41.

The base 22 provides a respective offset chamber 60 at the entry of the elongated sockets 38–39. The chambers each have an outer end wall 61 and a sloping wall 62 facing toward the respective socket which slopes downwardly away from the socket. Wedge blocks 64–65 occupy the chambers and have sloped wedge faces **64*a*–65*a* complementing the sloped chamber walls. The opposite walls of the wedge blocks which face the sockets 38–39 are vertical to function as jaw faces 64*b*–65*b* to engage the mounting members. The wedge blocks are shorter than the height of the chambers 60 and sockets 38–39. Each wedge block has a vertical threaded bore 67** open at the top.

Figure 2:
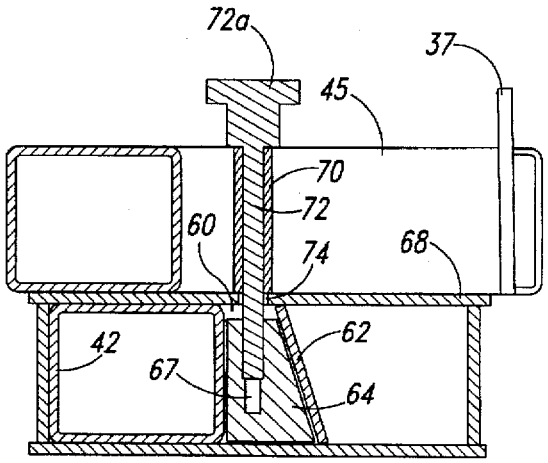
FIG. 2 is a fragmentary vertical section to an enlarged scale taken as indicated by line 2—2 of FIG. 1.
Figure 3:
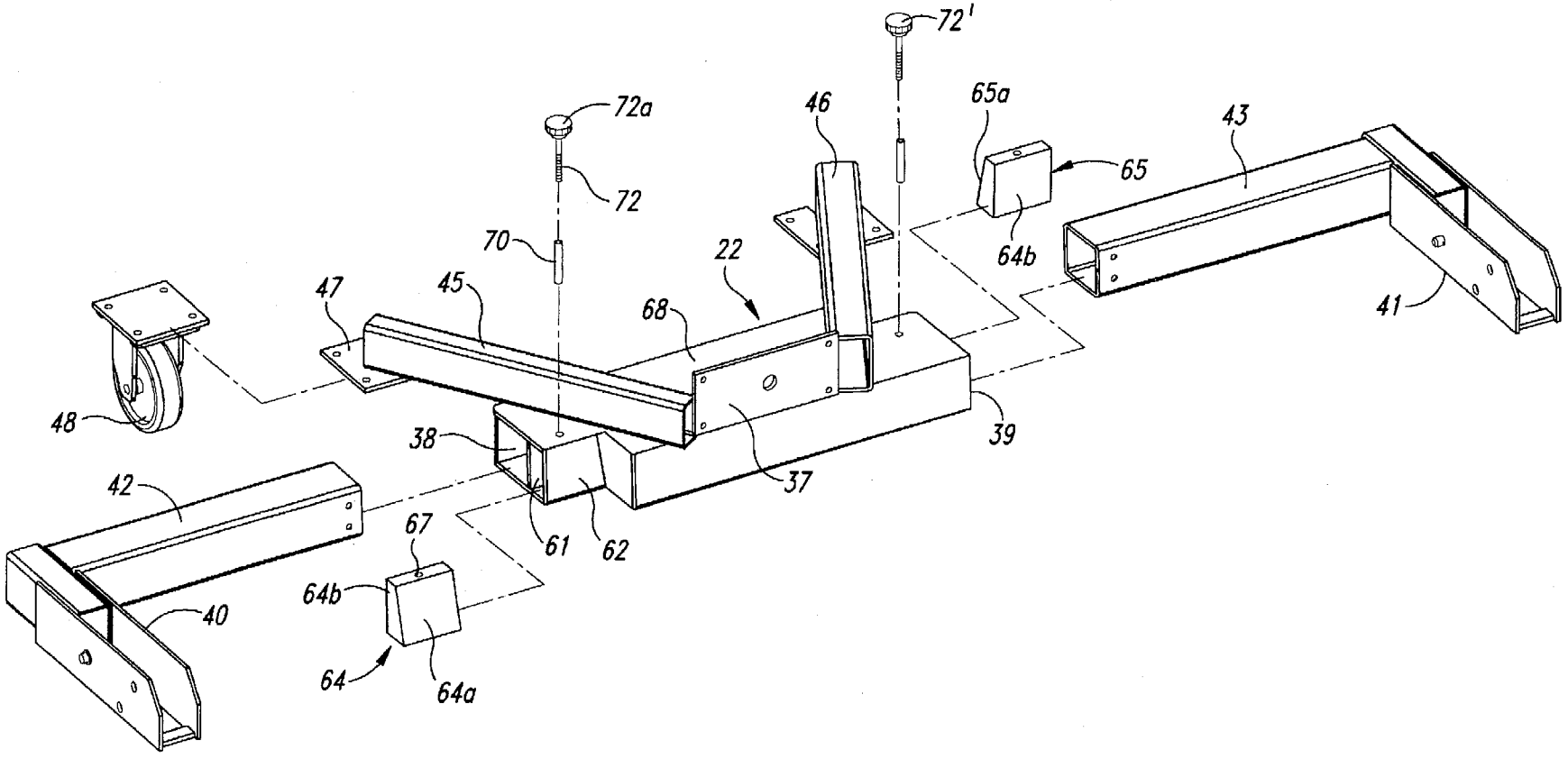
FIG. 3 is an exploded view of the locking system.

Seated on the top wall 68 of the base unit 22 are a pair of guide tubes 70. Adjustment screws 72 pass loosely through these guide tubes and a respective slot 74 in the top wall 68, and are screwed into the threaded bores 67 in the wedge blocks. The screws 72 have oversized heads **72*a* seated on the guide tubes 70 for manually turning the screws in the wedge blocks. Referring to FIG. 2, when the adjustment screw 72 at the right side of the lift is turned clockwise, for example, the right wedge block 64 is raised and its front sloped wedge face 64*a* rides upwardly on the sloped wall 62 of the respective chamber 60. This upward movement simultaneously moves the block horizontally in the rearward direction so that its rear vertical jaw face 64*b* is forced into engagement with the extensible mounting member 42 and clamps it against the opposite rear longitudinal side wall of the socket 38 so that the mounting member 42 is locked in position. The adjusting screw 72 and wedge block 65 on the left side of the lift operate in like manner for locking the left mounting member 43 and associated reach arm in selected position. However, when the adjusting screw 72' is tightened the left wedge block 65 moves in a forward direction to clamp the left mounting member 43 against the front longitudinal side wall of the left socket 39**.

By the described invention the distance between the reach arms 40–41 can be easily manually adjusted to laterally clear a pallet, for example, to be lifted by the forks 31, 32.

It will be apparent that the same locking system can be used for locking sliding outriggers on portable lifts.

From the foregoing it will be appreciated that, although specific embodiments of the invention have been described herein for purposes of illustration, various modifications may be made without deviating from the spirit and scope of the invention. Accordingly, the invention is not limited except as by the appended claims.

We claim:

1. A locking system on a portable lift comprising:

a base for a mast comprising a generally horizontal elongated socket having an entry end, said base including a chamber exposed to said socket by a side opening adjacent said entry end, said chamber having a downwardly sloping wall facing toward said socket;

an extension member slidably mounted in said socket; and a locking mechanism for said extension member including:

a wedge block in said chamber having a tapered face complementing and normally engaging said sloping wall, and having a jaw face facing toward said socket, said wedge block being confined against horizontal movement parallel to the length of said socket;

a spacer seated on said base above said chamber; and an adjustment bolt having an enlarged head engaging said spacer to prevent downward travel of said bolt, said bolt extending downwardly from its said head through an opening in said base into a threaded hole in said block such that turning of said bolt raises or lowers said block and responsively moves said tapered face on said sloping wall so as to responsively move said jaw face toward said socket for selectively engaging and locking said extension member relative to said base, said side opening being large enough to permit movement of said jaw face into locking engagement with said extension member.

2. A locking system according to claim 1 in which said socket and extension member each have a rectangular cross-section arranged such that the extension member presents a flat outer face opposite said chamber to be engaged by said jaw face of the wedge block.

3. A locking system according to claim 2 in which said jaw face is flat.

4. A locking system according to claim 1 in which said spacer comprises a tube through which said bolt extends, said bolt head engaging the top of said tube.

5. A locking system according to claim 1 in which said sloped wall slopes downwardly away from said socket and said wedge block moves upwardly and toward said socket responsive to turning of said bolt in a direction screwing the bolt into the block.

* * * * *